United States Patent [19]

Jenne

[11] 4,100,980

[45] Jul. 18, 1978

[54] SELF-PROPELLED PNEUMATIC BURROWING DEVICE

[75] Inventor: Gustav Jenne, Essen-Kettwig, Fed. Rep. of Germany

[73] Assignee: Jenne & Strahm AG fur Tiefbautechnik, Sarnen-Wilen, Switzerland

[21] Appl. No.: 690,629

[22] Filed: May 27, 1976

[30] Foreign Application Priority Data

May 31, 1975 [DE] Fed. Rep. of Germany ..... 2524210
May 31, 1975 [DE] Fed. Rep. of Germany ..... 2524211

[51] Int. Cl.[2] ..... E21B 11/02

[52] U.S. Cl. ..... 175/19; 73/132; 173/133; 91/234

[58] Field of Search ..... 175/19, 22, 61, 62; 173/132, 133; 91/234

[56] References Cited

U.S. PATENT DOCUMENTS

| | | | |
|---|---|---|---|
| 3,465,834 | 9/1969 | Southworth, Jr. | 175/73 X |
| 3,474,873 | 10/1969 | Zygmunt | 175/19 |
| 3,599,731 | 8/1971 | Lawlis | 173/133 X |
| 3,756,328 | 9/1973 | Sudnishnikov et al. | 175/19 X |
| 3,797,586 | 3/1974 | Coyne et al. | 173/133 |
| 3,865,200 | 2/1975 | Schmidt | 173/133 |

*Primary Examiner*—Ernest R. Purser
*Assistant Examiner*—Richard E. Favreau
*Attorney, Agent, or Firm*—Joseph A. Geiger

[57] ABSTRACT

A self-propelled pnuematic burrowing device having an axially reciprocating percussion plunger arranged inside a tubular casing so as to strike a percussion head at the forward extremity of the casing, thereby advancing the device through the ground by crushing and/or displacing the material in the path of the device, the percussion head being freely displaceable between axial abutments defined by a guide sleeve of the casing, the displaceability being slightly in excess of the advance of the device per stroke and adjustable through the insertion and removal of split spacer rings. The air controls of the device, located in the rear portion of the casing, include a control barrel with an enlarged control head and a gradually widening central air supply channel.

12 Claims, 6 Drawing Figures

SELF-PROPELLED PNEUMATIC BURROWING DEVICE

BACKGROUND OF THE INVENTION

1. Field of the Invention

The present invention relates to pneumatic percussion devices, and more particularly to pneumatic burrowing devices of the type which have a projectile-like outline and which propel themselves through the ground by displacing the materials which are in their path.

2. Description of the Prior Art

Several types of self-propelled pneumatic burrowing devices — sometimes also called ground torpedos or ground rockets — are known from the prior art. They all have in common that a heavy percussion plunger is arranged for longitudinal movement inside a cylindrical casing which carries a percussion head with a burrowing tip on its forward extremity and a supply line for compressed air on its rear extremity. The reciprocating movements of the percussion plunger, created by the action of the compressed air, cause the plunger to strike the percussion head at the end of its forward stroke, the rearward movement of the percussion plunger being obtained by temporarily opening air flow channels which lead the compressed air to the forward side of the percussion plunger and which are closed again, before the plunger reaches its rearward point of motion reversal. The hard impact of the percussion plunger against the percussion head drives the latter forwardly against the materials in its path be they soft ground or rock, the distance of penetration per impact varying from several millimeters to a fraction of a millimeter, depending upon the resistance encountered. The percussion head has a shoulder portion of a diameter which corresponds to the diameter of the casing of the device, so that the latter will follow the advance of the percussion head in reaction to the reversal of the percussion plunger motion, following its impact against the percussion head.

Burrowing devices of this type are thus capable of advancing through solid ground or rock, producing a substantially straight-line cylindrical channel of a diameter equal to the diameter of the casing of the device. This burrowing method is particularly suitable for the placement of underground cables and protective tubing for conduits such as water and/or gas supply lines, as well as sewerage lines, which can thus be installed without the need for digging any installation ditches. The method is particularly suitable for situations where channels have to be produced underneath buildings and structures, such as a street pavement, retaining walls, and other existing above-ground structures.

The burrowing devices in question are thus self-propelled and self-guided, and once pentrated into the ground are inaccessible for servicing or adjustment until they emerge at the point of destination, or are retrieved at the point of penetration. The devices, therefore, need to be very robust and operationally reliable, in addition to having a high degree of guidance accuracy, in order to emerge at the desired point of destination. Also, there may exist situations under which a burrowing device becomes stuck underground, in which case it becomes necessary to restart or reverse the movement of the device. Without this capability, the device could be irretrievably lost underground. Such self-propelled burrowing devices with restart and reversing features are known from the prior art. One such device is described in U.S. Pat. No. 3,865,200.

Another important operational problem complex of self-propelled burrowing devices relates to the configuration of the percussion head and to the interaction between this head and the percussion plunger. In one known prior art device, the percussion head has a pointed penetration tip in the shape of a projectile tip, the head being solidary with the cylindrical casing, either rigidly attached thereto, or formed as an integral portion of the latter. This rigid connection accounts for the fact that the casing of this type of burrowing device is subjected to elevated impact stress conditions which tend to produce fissures in the casing wall. Accordingly, the longevity of this type of device is a comparatively short one.

In order to avoid the aforementioned stress conditions on the casing of the burrowing device, it has therefore already been suggested that the percussion head should have a limited axial mobility in relation to the casing, while a spring is arranged between the casing and the percussion head so as to urge the latter rearwardly against the casing. The result is that the impact of the percussion plunger against the rearwardly biased percussion head is not immediately transmitted to the casing, but causes the percussion head to advance by compressing the spring which then assists the compressed air in pushing the casing forwardly so as to follow the advance of the percussion head. This arrangement greatly reduces the stress which is created on the casing of the device, while increasing its operational longevity correspondingly. The provision of an adjustable preload on the spring between the percussion head and the casing further makes it possible to adapt the kinematic interaction between the percussion head and the casing to different operational conditions in accordance with the burrowing resistance encountered in the ground.

It has been found, however, that the arrangement of the percussion head as a longitudinally displaceable, spring-biased member of the burrowing device has certain operational shortcomings which manifest themselves primarily in the form of a reduced accuracy of straight-line guidance and in a less favorable utilization of the percussion energy. The lower energy efficiency is due to the fact that a portion of the initial impact energy which is transferred from the percussion plunger to the percussion head is absorbed by the spring, to be released later, when it either advances the casing or retracts the percussion head.

The spring displacement, in order to produce an appreciable damping action, must be at least 10 mm, meaning that the axial displaceability of the percussion head relative to the casing must be equal to that distance. The actual penetration advance, however, varies between 0.1 and 3 mm per plunger impact, so that there exists the possibility that, due to friction between the ground and the casing, the latter will not advance at all, or only by a lesser distance than the percussion head, and that the percussion head will subsequently be retracted from its advanced position through the action of the spring. If this happens, then the initial impact of the percussion plunger against the percussion head causes the latter to rebound forwardly until it reaches its previous most advanced position, thereby dissipating a portion of the impact energy.

The aforementioned tendency of this prior art device to retract the percussion head from its advance position leads to a hammering action between the percussion head and the casing which may lead to an axial "dancing" movement of the entire burrowing device, especially when the surrounding ground is soft and the percussion head suddenly encounters a hard layer of material such as rock or a block of concrete, for example. This dancing movement of the burrowing device in soft ground produces an enlarged, often elliptical, channel cross section around the casing of the device, with the result that its straight-line guidance is no longer accurately maintained and that the device may accordingly deviate from its intended direction of advance.

SUMMARY OF THE INVENTION

Underlying the present invention is the objective of devising an improved self-propelled pneumatic burrowing device of the earlier-mentioned type, where the indicated shortcomings of the prior art devices are avoided, so that the device operates with a high degree of energy efficiency and advances along a straight line, even under very difficult ground conditions.

The present invention proposes to attain this objective by suggesting a self-propelled burrowing device with a percussion head which is floating, i.e. freely movable in relation to the casing between two axial abutments. These abutments are so adjusted that the axial displaceability of the percussion head in relation to the casing is only a small amount larger than the incremental advance of the burrowing device during each movement cycle of the percussion plunger.

This limited axial displaceability of the percussion head in relation to the casing, which is not in any way subjected to a spring bias, results in the direct undamped transfer of the entire kinetic energy of the percussion plunger to the percussion head. Accordingly, the entire energy is utilized for the advance of the percussion head and, as the case may be, for the crushing of obstacles which are encountered by the percussion head in its path. The axial mobility of the percussion head relative to the casing assures at the same time that the elevated initial impact force which is imparted to the percussion head is not immediately also transmitted to the casing, so that the latter is not only not subjected to the resultant impact stresses, but is also free of vibrations to which the prior art devices are particularly prone, when rocks which are surrounded by soil are to be crushed.

As mentioned earlier, the prior art devices which have a spring-biased percussion head tend to develop an undesirable hammering interaction between the spring-loaded percussion head and the casing, when the aforementioned ground conditions are present. The resultant "dancing" reaction of the device then produces an enlarged channel which, in turn, may negatively affect the directional stability of the device. The fact that the displaceability of the percussion head is only a short distance greater than the incremental advance of the device per plunger stroke and that no spring-generated reaction occurs between the percussion head and the casing of the device means that the percussion head remains at all times in contact with the materials just ahead of it, so that the displacement work of the percussion head, and particularly its displacement work in the elastic range of the surrounding material, need not be re-expended by the device.

In a preferred embodiment of the invention, the axial displacement freedom of the percussion head in relation to the casing is made adjustable by means of spacer rings, the number of rings used determining the distance over which the percussion head is movable. These distance rings are preferably split rings, in order to permit insertion and removal of the rings from the side, without modification of the burrowing device. This adjustability makes it possible to adapt the axial freedom of the floating percussion head in the casing in accordance with the characteristics of the surrounding ground and in accordance with other operating conditions, so that an optimal operation is achievable at all times.

For special applications, as when the burrowing device is used to drive steel pipes into the ground and where the device remains outside of the ground at all times, the axial displaceability of the percussion head may be eliminated entirely. On the other hand, it should be noted that, instead of adjusting the axial freedom of the percussion head in relation to the cooperating guide sleeve of the casing, it is also possible to provide a burrowing device with interchangeable percussion heads and matching guide sleeves for different ground conditions, the displacement distances of each percussion head in relation to the guide sleeve varying from head to head.

The present invention further suggests, as another advantageous feature, that the tip of the percussion head be provided with a comparatively large front face, the outline of which is preferably round and perpendicular to the axis of the device, the working face itself being preferably concave. This configuration has for its purpose that the advancing percussion head will first crush a major portion of the materials which it encounters in its path, before the materials are compacted and displaced laterally. This feature is of great significance, since the creation of the desired channel requires the lateral displacement of a corresponding quantity of materials into an annular zone surrounding the channel. In the case of ordinary soil or other loosely deposited materials, adequate space is available in the zone which surrounds the channel. However, where dense material layers or other non-compressible obstacles such as large rocks are encountered in the path of the burrowing device, there will not be sufficient room in the immediate vicinity of the device to laterally displace these obstacles out of the way of the burrowing device. The novel configuration of the percussion head makes it possible to crush a major portion of these obstacles into fragments, which will make it easier to then displace these fragments laterally into the ground surrounding the burrowing device. The result of this operational improvement not only enhances the directional stability of the device, it also reduces the risk of creating surface bulges in situations where the path of the burrowing device is located close to the surface.

The prior art suggests two basically different approaches for the supply of compressed air to the burrowing device. One of these approaches involves the introduction of compressed air into the device via a reciprocating valve plunger, while the other approach suggests the arrangement of a stationary control barrel which cooperates with a matching bore of the percussion plunger and radial control passages leading into that bore. The forward edge of a head portion of the stationary barrel, opening and closing the radial passages in the percussion plunger, determines the distance of rearward motion of the latter, so that, when the control barrel is repositioned rearwardly, it also shifts the stroke of the percussion plunger, which then abuts rearwardly against a flange of the device, resulting in a reversal of the movement of the burrowing device. Appropriate means for remotely controlling this repositioning of the control barrel thus serve to reverse the burrowing device from an advancing movement to a backup movement.

It has been found that the devices which use a reciprocating valve plunger are subject to a considerable amount of wear on these plungers, with the result that the longevity and reliability of these devices is seriously impaired. Additional problems associated with this type of device relate to the difficulty of restarting a device, once it has stopped moving. Complex and costly accessory devices are necessary, in order to overcome these problems, and these devices are, in turn, susceptible to their own operational problems. For these reasons, the preference among users has definitely shifted away from the type of device which uses a reciprocating valve plunger to control the reciprocating movement of the percussion plunger under a supply of compressed air.

In the type of device which controls the percussion plunger movement with a stationary control barrel and radial control passages in the wall of the percussion plunger, the reversal of the percussion plunger motion from the rearward direction to the forward direction involves the closing of these radial control passages, as they move past the forward edge of a control head on the control barrel, so that a closed space is created between the blind end of the plunger control bore and the supply channel for compressed air. The subsequent rearward displacement of the percussion plunger decreases this enclosed space, thereby pushing some of the enclosed air back into the supply channel, in opposition to the pressure of the air in the supply line, until enough kinetic energy has been removed from the percussion plunger to stop its rearward motion and to initiate the next forward stroke. The result of this forced backup of air into the supply channel for compressed air creates a corresponding reaction on the casing of the burrowing device — the casing holds the control barrel — so that it may happen that the entire burrowing device will execute a rearward displacement, especially in situations where the surrounding ground is soft and where the burrowing device encounters a comparatively low frictional resistance. This tendency will contribute to the "dancing" phenomenon described earlier in connection with burrowing devices which have a spring-biased percussion head.

The present invention further proposes to improve the self-propelled pneumatic burrowing device by suggesting a stationary control barrel for the compressed air supply, where the described shortcoming of the prior art devices is eliminated.

The invention proposes to achieve this result by suggesting that the central supply channel inside the head of the control barrel be so designed that it gradually opens from the diameter of the air supply line to a larger outlet diameter at the forward edge of the control barrel. This gradual opening, according to a further suggestion of the present invention, may be either tapered in the shape of a funnel or cone, or it may have a nonlinear diametral progression which first increases and then decreases, so as to create a double-curved cross-sectional outline. The outlet diameter at the forward edge of the control barrel is preferably as large as possible, the result being a sharp, blade-like control edge on the head of the control barrel.

The proposed novel air channel configuration in the control barrel improves the air flow characteristics by eliminating abrupt air pressure increases and decreases at the forward edge of its head, especially during the rearward motion of the percussion plunger, when the radial control passages are closed by the control head and when, thereafter, a certain quantity of air is pushed back into the supply channel against the pressure of the compressed air which is contained inside the latter. Besides eliminating these pressure surges, which may be blamed at least in part for the tendency of prior art devices to vibrate and execute backup motions, the new supply channel configuration improves the pneumatic efficiency of the device by eliminating undesirable air turbulence during the advancing stroke of the percussion plunger. The overall result of this inventive contribution is an improved directional stability of the device, a smoother operation of the percussion plunger, and a significant reduction in the vibrations which are imparted to the casing during the crushing of rocks.

BRIEF DESCRIPTION OF THE DRAWINGS

Further special features and advantages of the invention will become apparent from the description following below, when taken together with the accompanying drawings which illustrate, by way of example, a preferred embodiment of the invention, represented in the various figures as follows.

DESCRIPTION OF THE PREFERRED EMBODIMENT

Figure 1:
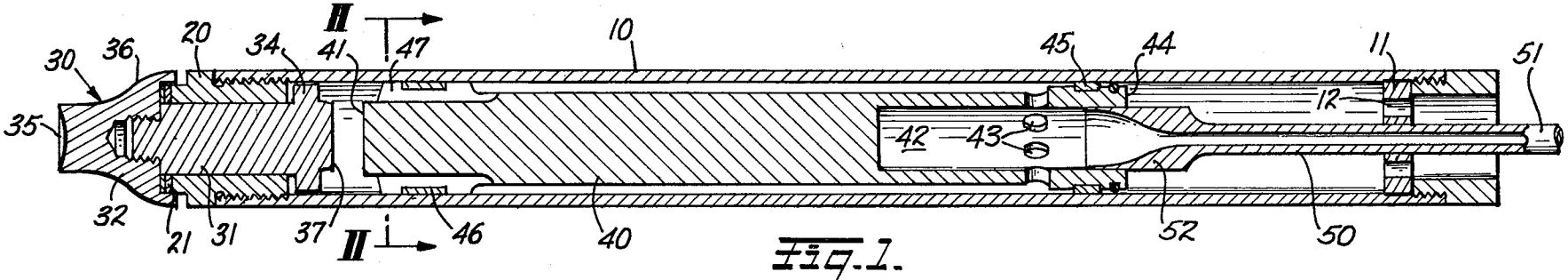
FIG. 1 is a longitudinal cross section of a pneumatic burrowing device embodying the present invention.

Referring to FIG. 1 of the drawing, there is shown a self-propelled pneumatic burrowing device whose elongated tubular casing 10 carries on its forward extremity a percussion head 30 with a percussion tip 32 of smaller diameter which is supported in axial alignment with the casing 10 inside a guide sleeve 20. The latter has a threaded portion with which it engages a matching threaded bore portion in the forward extremity of the casing 10. The guide sleeve 20 is thus fixedly attached to the casing 10, while being removable therefrom, when unscrewed from the casing.

The percussion head 30 is axially movable in relation to the guide sleeve 20, as will be explained with reference to FIG. 3. There, it can be seen that the percussion head consists of a guide pin 31 which is axially guided inside the guide sleeve 20 and which carries on a forwardly extending threaded portion 33 a percussion tip 32 of generally bell-shaped outline. The percussion tip 32, having a maximum diameter approximately equal to the diameter of the adjacent guide sleeve 20 and casing 10, forms a rearwardly oriented abutment face 38 which, together with a forwardly oriented abutment face of an abutment collar 34 on the rear extremity of the guide pin 31, cooperates with the axial extremities of the guide sleeve 20 to give the percussion head a limited axial displaceability in relation to the fixed guide sleeve 20.

The guide sleeve 20 and the percussion head carried by it can thus be readily removed from the device and replaced with a new and/or different percussion head. The forward extremity of the hardened percussion tip 32 is preferably shaped like a piercing punch, having a comparatively large acutely angled circular edge surrounding a concave working face 35. A double curve forms a smooth transitional outline between the approximately cylindrical forward portion of the percussion tip and the larger shoulder portion 36 of the percussion tip which extends rearwardly over a radially recessed portion of the guide sleeve 20, so as to form a continuous outline along which the material is laterally displaced and compacted, as the burrowing device advances in the axial direction. The displacement shoulder 35 and the abutment collar 34 may have facets for the engagement with wrenches. Similar facets or other wrench-engageable surface features may be provided on the shoulder portion of the guide sleeve 20.

The major portion of the cavity of the casing 10 forms a smooth bore and is occupied by a heavy percussion plunger 40 which is guided in that bore for an axial reciprocating motion during which the plunger 40 hammers against the percussion head 30, as its forwardly facing hammer face 41 strikes the anvil face 37 of the percussion head guide pin 31. This reciprocating motion of the percussion plunger 40 is obtained with the aid of compressed air which enters the device through a rearwardly extending air supply line 51 leading to a stationary control barrel 50. The latter is positioned inside the casing 10 of the device by means of a positioning ring 11.

Figure 4:
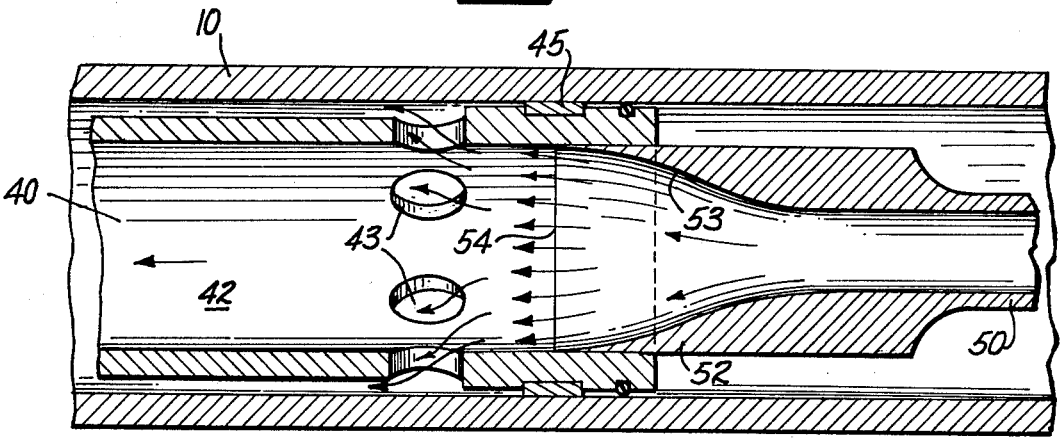
FIG. 4 shows a rearward intermediate portion of the device of FIG. 1 at a similarly enlarged scale.
Figure 5:
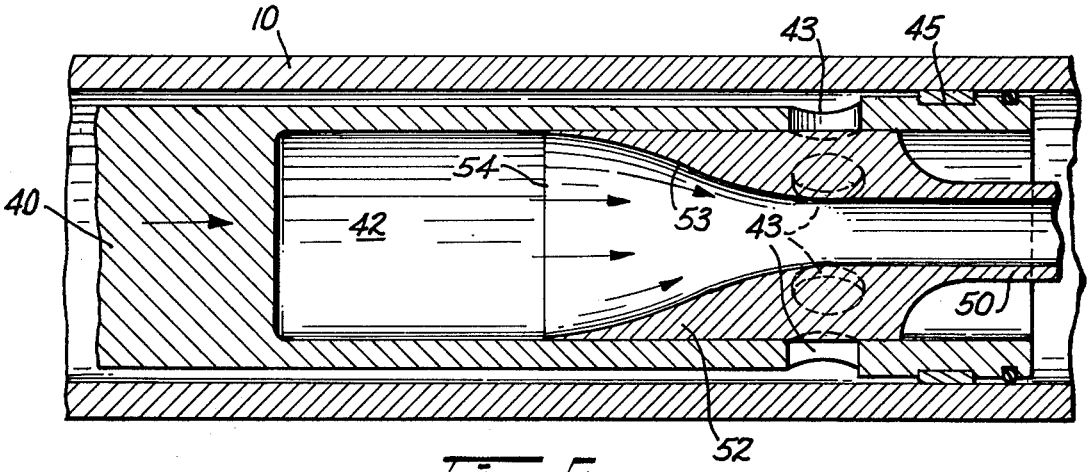
FIG. 5 shows the component parts of FIG. 4 in a different operational position.

The cooperation between the control barrel 50 and the percussion plunger 40 is illustrated in more detail in FIGS. 4 and 5, where it can be seen that the forward end portion of the control barrel 50 forms an enlarged control head 52 which engages a matching rearwardly open plunger control bore 42. In this bore is arranged a series of radial control passages 43 which lead from the inside of bore 42 to the periphery of the percussion plunger 40 and, along an annular gap between the latter and the bore of the casing 10, connect the bore 42 to the forward side of the plunger 40. The stationary control head 52 thus acts as a valve member in cooperation with the radial control passages 43 of the plunger 40, as the latter moves back and forth over its forward edge 54. The used air escapes rearwardly through exhaust passages 12 in the positioning ring 11 (FIG. 1).

The air supply line 51, which continues as a central bore inside the control barrel 50, opens at the forward end of the control head 52 in the form of a radially enlarged bore which has an exit diameter almost as large as the outside diameter of the head 52. As can be seen in FIGS. 4 and 5, the central supply channel inside the control head 52 thus widens in the manner of a nozzle, the cross-sectional outline of the bore forming a smooth double curve, as the diametral progression of the bore enlargement from its smallest diameter to its maximum diameter at the edge 54 first increases and decreases. This flow profile of the supply channel 53 assures a turbulence-free, smooth air flow from the supply line 51 into the larger plunger control bore 42 and in reverse, when the percussion plunger reaches its rear motion reversal range, as will be explained further below. The forward edge 54 of the control head 52 thus forms a sharp, blade-like extremity on the control barrel.

Figure 2:
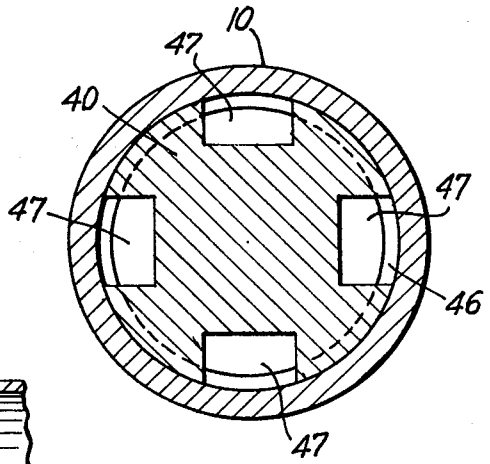
FIG. 2 is an enlarged transverse cross section of the device of FIG. 1, taken along line II—II thereof.
Figure 3:
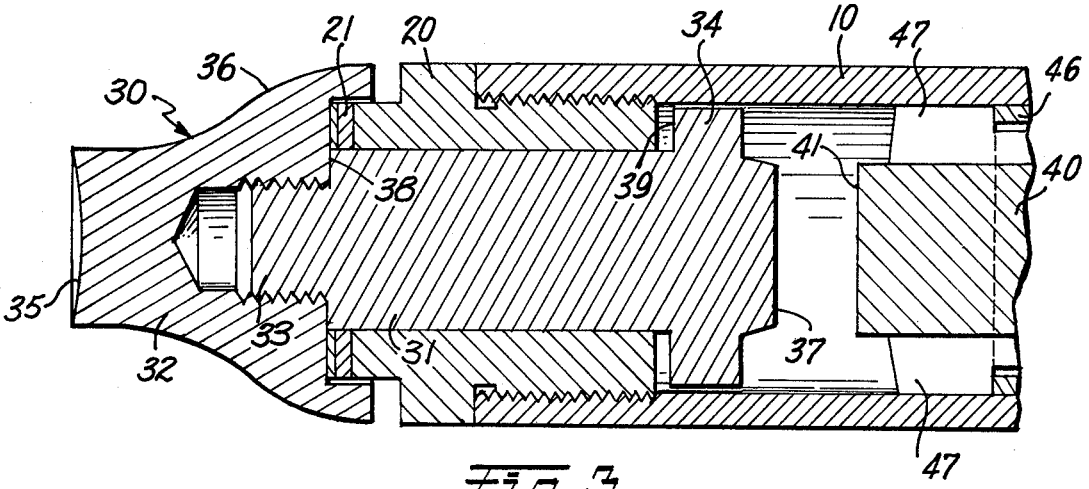
FIG. 3 shows the forward portion of FIG. 1 at an enlarged scale.

In operation, compressed air enters the device through the air supply line 51 and the widening supply channel 53, where it leaves the control barrel and impinges upon the blind portion of the plunger control bore 42, thereby driving the percussion plunger 40 forwardly until it strikes the percussion head 30, when the hammer face 41 on the forward extremity of the plunger reaches the anvil face 37 on the rear extremity of the percussion head 30 (FIG. 3). However, before the percussion plunger 40 reaches the percussion head 30, its radial control passages 43 become exposed to the compressed air (see FIG. 4), as they move forwardly beyond the edge 54 of the control head 52. Compressed air now flows through the passages 43 into the annular space between the control plunger 40 and the casing 10. From there, the compressed air reaches the space between the percussion plunger 40 and the guide sleeve 20, so that the air presses against the percussion plunger 40 in the rearward sense, affecting the entire cross-sectional area of the plunger. Since this area is larger than the forwardly effective pressure area of the plunger control bore 42, the percussion plunger 40 is driven rearwardly. The air reaches the forward extremity of the percussion plunger 40 by flowing through a series of axial channels 47 (FIG. 2) which are arranged on the circumference of the plunger 40, in an enlarged forward end portion of the plunger. A similar enlarged plunger portion guides the plunger 40 on its rear end; the two guide portions carry slide rings 45 and 46, respectively.

In the course of the rearward motion of the percussion plunger 40, its control passages 43 are again closed, as they move past the edge 54 of the control head 52. This means that the exit of compressed air from the supply channel 53 is blocked, while the plunger 40 continues to move rearwardly, thereby reducing the available air volume in the enclosed space which is formed by its control bore 42 and the cooperating control head 52 of the barrel 50. The result is a braking action on the rearwardly moving percussion plunger 40 against an air cushion, while a certain amount of air is pushed back into the supply channel 53, in opposition to the air pressure existing in the air supply line 51. This resistance produces a smooth deceleration and reversal of the plunger motion. Before the percussion plunger 40 reaches this reversal point, its radial control passages 43 are again exposed, as they move over the rear edge of the control head 52, thus allowing the residual air pressure in the annular space between the plunger 40 and the casing 10 to be discharged from the device through the exhaust passages 12 of ring 11.

As the flow arrows in FIG. 4 and FIG. 5 indicate, air flows through the widening central supply channel 53 of the control head 52 in both directions during each motion cycle of the percussion plunger. The flow conditions in this portion of the device are therefore important with respect to the operational efficiency and stability of the device. The particular shape of this supply channel 53, designed to minimize air turbulence and sudden pressure changes, thus also reduces to a minimum the reaction on the casing 10 which is necessarily created by the reversal of the plunger motion, as the air which is pushed back into the supply line 52 during the deceleration of the plunger, before it reaches the end of its rearward motion, creates a corresponding reaction force which is transmitted to the casing 10 over the control barrel 50 and the positioning ring 11. The difference between a smooth increase of this reaction force and a sudden surge is the difference between vibrations and reverse movements of the device in one case, and the absence of vibrations and elimination of the undesirable reverse movements, in the other case. The novel channel configuration also improves the operational characteristics of the device during the power stroke of the percussion plunger 40, due to the absence of turbulence in the air flow, which means that a higher pressure on the plunger is obtained.

The movement of the burrowing device is reversible, when the control barrel 50 is axially repositioned by moving it rearwardly in relation to the positioning ring 11. This reversal method is similar to the one described in U.S. Pat. No. 3,865,200. The repositioned control head 52 opens and closes the radial control passages 43 of the percussion plunger 40 at correspondingly different axial positions of the latter, with the result that the air cushion which is established on the forward side of the percussion plunger 40 reverses the forward motion of the latter into a rearward motion before the face 41 of the plunger reaches the face 37 of the percussion head 30, while, on the other hand, the buildup of a motion-reversing air cushion between the blind end of the plunger bore 42 and the control head 52 is insufficient to stop the rearward motion of the percussion plunger 40, before the rear face 44 of the latter reaches the positioning ring 11 and, by striking the latter, moves the device rearwardly.

The percussion head 30, which consists of a percussion tip 32 screwed onto a guide pin 31, is axially movable between opposite abutment faces 38 and 39 of the tip 32 and of the pin collar 34, respectively (FIG. 3). The difference between the axial length of the guide sleeve 20 and the axial distance between the abutment faces 38 and 39 thus determines the axial displaceability of the percussion head 30. This distance is significant for an optimal performance of the device, and it is therefore preferably just a short distance greater than the forward progression of the burrowing device during each movement cycle of the percussion plunger 40. Under normal conditions, the device advances between 0.1 and 3 mm per stroke, when a percussion plunger reciprocates at between 300 and 500 cycles per minute.

Figure 6:
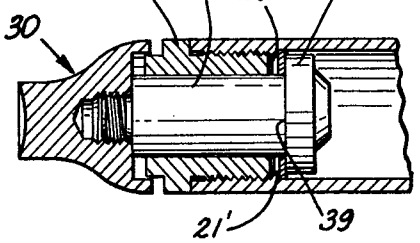
FIG. 6 shows a modification of the forward portion of the pneumatic burrowing device of FIGS. 1 and 3.

It may therefore be advantageous to provide an adjustability of the axial movement freedom of the percussion head 30 in relation to the guide sleeve 20. This can be achieved by arranging removable spacer rings 21 between the guide sleeve 20 and the percussion head 30. These spacer rings 21 are preferably split, in order to facilitate their lateral insertion and removal. It should be understood that the arrangement of the spacer rings 21 need not be on the forward extremity of the guide sleeve 20, as shown in FIGS. 1 and 3, but could also be arranged on the rear of sleeve 20 between the rear face 29 of the latter and the abutment face 39 of the guide pin collar 34. Such an arrangement is shown in FIG. 6. Alternatively, spacer rings may be arranged between the percussion tip 32 and the guide pin 31 of the percussion head. Lastly, it is also possible to have several interchangeable percussion head assemblies, each assembly including a guide sleeve, and each having a different axial displaceability of the percussion head.

As the percussion plunger 40 strikes the anvil face 37 of the percussion head 30, its entire kinetic energy is available to drive the head, so that the latter is rammed forwardly against the materials located in the path of the burrowing device. Only a residual amount of energy is transferred to the casing 10 itself, for the advance of the latter, after the first impact between the percussion plunger 40 and the percussion head 30 has taken place. This has the advantage that undamped blows are imparted to the percussion head 30, while the casing 10 and the device itself are drawn forwardly with energy pulses having a much reduced sharpness of impact.

It should be understood, of course, that the foregoing disclosure describes only a preferred embodiment of the invention and that it is intended to cover all changes and modifications of this example of this invention which fall within the scope of the appended claims.

I claim the following:

1. A pneumatic burrowing device designed to propel itself through the ground along a straight line by crushing and/or displacing the materials which it encounters in its path, the device comprising in combination:

an elongated tubular casing defining a cylindrical bore and a longitudinal center axis and movement axis of the device;

a percussion head arranged on the forward extremity of the casing in alignment with said center axis and guided so as to be axially freely movable a limited distance in relation to the casing;

two pairs of cooperating axial abutment faces defined by the casing and by the percussion head, respectively, said abutment faces determining between them the distance over which the percussion head is freely displaceable;

means for axially respositioning at least one of said abutment faces relative to the other abutment faces so as to adjust said distance of displaceability;

a massive percussion plunger received and guided inside said casing bore for reciprocating axial fore and aft movements, the percussion plunger having a rearwardly open control bore in its rear portion;

a control barrel arranged in axial alignment with the casing bore and reaching from the rear of the device a distance into the casing bore, the control barrel being held in place by the casing and having connected to it a rearwardly extending supply line for compressed air, while carrying on its forward extremity an outwardly cylindrical control barrel head matching in its diameter the control bore of the percussion plunger and serving as a plunger valve in cooperation with the latter; and air flow controlling means defined by said percussion plunger bore and said cooperating control barrel head for deriving from a flow of compressed air received through said supply line a continuously cycling reciprocating motion of the percussion plunger between axial stroke limits which are determined by the axial position of said control barrel head, whereby said barrel head is normally so positioned that the percussion plunger, in its forward motion, strikes the percussion head before reaching the forward stroke reversal point determined by said air flow controlling means, thereby forcibly advancing the percussion head a certain distance against the materials situated in the path of the device; and wherein the distance over which the percussion head is axially freely displaceable in relation to the casing is adjustable to be slightly greater than the normal distance of advance of the percussion head in the ground per impact.

2. A burrowing device as defined in claim 1, wherein the casing carries on its forward extremity a guide sleeve with an axial guide bore for the percussion head;

the guide sleeve has oppositely oriented abutment faces on its axial extremities; and the percussion head includes a guide portion engaging the axial guide bore of the guide sleeve and has opposite, axially inwardly facing abutment faces cooperating with said abutment faces of the guide sleeve, thereby determining said distance over which the percussion head is axially displaceable relative to the casing of the device.

3. A burrowing device as defined in claim 2, wherein the axial repositioning means includes at least one spacer ring which is removably interposed between a pair of cooperating abutment faces.

4. A burrowing device as defined in claim 3, wherein said spacer ring, or rings, respectively, is located on the forward side of the guide sleeve.

5. A burrowing device as defined in claim 3, wherein said spacer ring, or rings, respectively, is arranged on the rear side of the guide sleeve.

6. A burrowing device as defined in claim 3, wherein said spacer ring, or rings, respectively, is transversely split, so as to permit radial insertion and removal of the ring.

7. A burrowing device as defined in claim 1, wherein the percussion head includes a percussion tip having a forwardly facing circular working edge surrounding a working face of a diameter which is no less than one-fourth of the diameter of the casing.

8. A burrowing device as defined in claim 7, wherein the working face of the percussion tip is concave and the working edge surrounding said face defines an angle of less than 90°;

the percussion tip includes a displacement shoulder whose cross-sectional outline forms a transition between the working edge and a diameter on the rear extremity of the percussion tip which is at least as large as the outside diameter of the casing.

9. A burrowing device as defined in claim 8, wherein the cross-sectional outline of the displacement shoulder of the percussion tip resembles the shape of a bell, being essentially composed of a double curve with axially oriented end portions.

10. A pneumatic burrowing device designed to propel itself through the ground along a straight line by crushing and/or displacing the materials which it encounters in its path, the device comprising in combination:

an elongated tubular casing defining a cylindrical bore and a longitudinal center axis and movement axis of the device;

a percussion head arranged on the forward extremity of the casing in alignment with said axis and so as to be axially freely movable a limited distance in relation to the casing;

a massive percussion plunger received and guided inside said casing bore for reciprocating axial fore and aft movements, the percussion plunger having a rearwardly open control bore in its rear portion;

a control barrel arranged in axial alignment with the casing bore and reaching from the rear of the device a distance into the casing bore, the control barrel being held in place by the casing and having connected to it a rearwardly extending supply line for compressed air, while carrying on its forward extremity an outwardly cylindrical barrel head matching in its diameter the control bore of the percussion plunger and serving as a plunger valve in cooperation with the latter; and a plurality of radial control passages in the wall surrounding the control bore of the percussion plunger, which passages cooperate with the two axial extremities of the control barrel head in such a way that compressed air supplied through said barrel head, via the supply line, produces a continuously cycling reciprocating motion of the percussion plunger between axial stroke limits which are determined by the length and axial position of the control barrel head, whereby the latter is normally so positioned that the percussion plunger in its forward motion, strikes the percussion head before reaching the forward stroke reversal point determined by the radial control passages and the forward extremity of the control barrel head, thereby forcibly advancing the percussion head a certain distance against the materials situated in the path of the device; and wherein the distance over which the percussion head is axially freely displaceable in relation to the casing is slightly greater than the normal distance of advance of the percussion head in the ground per impact;

the control barrel defines a central supply channel extending from the air supply line, through the control barrel and its control barrel head, into the control bore of the percussion plunger, the diameter of said central supply channel, at its outlet to said control bore, being a minimal amount smaller than said bore itself, the supply channel widening gradually and smoothly to said outlet diameter, for a minimum of air turbulence therein.

11. A burrowing device as defined in claim 10, wherein the widening portion of the central channel is funnel-shaped, having the cross-sectional outline of a cone.

12. A burrowing device as defined in claim 10, wherein the widening portion of the central supply channel has a cross-sectional outline which follows a smooth double curve, therby defining a non-linear diametral progression from its smallest diameter to said outlet diameter, which progression increases along a first curve portion and decreases along the second curve portion of said double curve.

* * * * *